US006323586B1

(12) United States Patent
Zhurin et al.

(10) Patent No.: US 6,323,586 B1
(45) Date of Patent: Nov. 27, 2001

(54) CLOSED DRIFT HOLLOW CATHODE

(75) Inventors: Viacheslav V. Zhurin; James R. Kahn, both of Ft. Collins; Harold R. Kaufman, LaPorte, all of CO (US)

(73) Assignee: Front Range Fakel, Inc., Ft. Collins, CO (US)

( * ) Notice: Subject to any disclaimer, the term of this patent is extended or adjusted under 35 U.S.C. 154(b) by 0 days.

(21) Appl. No.: 09/264,477

(22) Filed: Mar. 8, 1999

(51) Int. Cl.[7] ..... H01J 1/50
(52) U.S. Cl. ..... 313/156; 313/310
(58) Field of Search ..... 313/310, 153, 313/359.1, 361.1, 362.1, 156, 157

(56) References Cited

U.S. PATENT DOCUMENTS

| | | | | |
|---|---|---|---|---|
| 3,515,932 | | 6/1970 | King . | |
| 3,523,210 | | 8/1970 | Ernstene et al. . | |
| 4,633,129 | * | 12/1986 | Cuomo et al. | 313/153 |
| 5,132,597 | * | 7/1992 | Goebel et al. | 313/359.1 |
| 5,359,254 | | 10/1994 | Arkhipov et al. . | |
| 5,763,989 | * | 6/1998 | Kaufman | 313/361.1 |

OTHER PUBLICATIONS

Ljapin et al., "Neutralizer with closed electron drift", Proceedings of VII All–Union Conference on Plasma Accelerators and Ion Injectors, pp. 217–218, USSR, Kharkov, Sep. 26–28, 1989.

* cited by examiner

*Primary Examiner*—Nimeshkumar D. Patel
*Assistant Examiner*—Todd Reed Hopper
(74) *Attorney, Agent, or Firm*—Dean P. Edmundson

(57) ABSTRACT

In accordance with one specific embodiment of the present invention, the closed drift hollow cathode comprises an axisymmetric discharge region into which an ionizable gas is introduced, an annular electron emitting cathode insert disposed laterally about that discharge region, a surrounding enclosure, an aperture in that enclosure disposed near the axis of symmetry and at one end of that region, and a magnetic field within that region which is both axisymmetric and generally disposed transverse to a path from the cathode insert to the aperture. An electrical discharge is established between the cathode insert and the enclosure. The electrons emitted from the cathode insert drift in closed paths around the axis, collide with molecules of ionizable gas, and sustain the discharge plasma by generating additional electron-ion pairs. Ions from the plasma bombard the cathode insert, thereby maintaining an emissive temperature. Electrons from the plasma diffuse to and escape through the aperture to provide the electron emission. The closed drift nature of the discharge circumferentially distributes the heating of the cathode insert and the utilization of the electron emitting capabilities thereof. The discharge current controls the maximum value of the electron emission.

8 Claims, 4 Drawing Sheets

CLOSED DRIFT HOLLOW CATHODE

FIELD OF INVENTION

This invention relates generally to electron emitting cathodes, and more particularly to hollow cathodes that utilize a flow of ionizable gas.

This invention can find application in a variety of devices that employ electron emitting cathodes in electrical discharges, such as ion thrusters used in space propulsion and ion sources used in industrial applications.

BACKGROUND ART

Electron emitting cathodes are used in a variety of low pressure plasma devices, where low pressure is defined as extending downward from a maximum of about 10 millitorr (1.3 Pascal). They are used in gridded ion sources, as described in an article by Kaufman, et al., in the *AIAA Journal*, Vol. 20 (1982), beginning on page 745. They are also used in gridless ion sources, as described in U.S. Pat. No. 4,862,032—Kaufman, et al. Ion thrusters also use electron emitting cathodes, as described in U.S. No. Pat. 5,359,254—Arkhipov, et al. Ion thrusters are generally similar to industrial ion sources, except that they are used for space propulsion instead of industrial applications. Note that the ion sources described generate broad ion beams that require the presence of charge neutralizing electrons within the ion beam in order to operate.

A beam of energetic ions together with the charge neutralizing electrons constitutes a plasma. Ion sources may therefore also be called plasma sources.

Electron emitting cathodes are also used in other devices such as magnetrons, as described in U.S. Pat. No. 4,588,490—Cuomo, et al.

The specific form of the electron emitting cathode can vary. The simplest is a hot filament of a refractory metal, such as tungsten or tantalum, as described in the aforementioned article by Kaufman, et al., in the *AIAA Journal*. A hot filament has an important advantage in that the electron emission is directly controllable by adjusting the electrical power used to heat the hot filament.

A hot filament is subject to space-charge limitations, which means that it must be immersed in a plasma to achieve close electrical coupling with that plasma—that is, without an excessive voltage between the cathode and the plasma. For example, a hot filament cannot be used as a neutralizer (to current neutralize an ion beam) in a gridded ion source without being immersed in the beam of energetic ions that it is neutralizing. It also has the shortcoming of having a short lifetime when it is exposed to bombardment by energetic ions. The lifetime problem becomes more severe when reactive gases such as oxygen are present.

Another form of electron emitting cathode is the hollow cathode, as described in U.S. Pat. No. 3,515,932—King, U.S. Pat. No. 3,523,210—Ernstene, et al., and U.S. Pat. No. 5,359,254—Arkhipov, et al. In a hollow cathode, there is an ionizable gas flowing into a cavity and out an aperture. The emission in a hollow cathode is also thermionic, perhaps enhanced with high-field emission due to the dense internal plasma. In operation, a plasma extends from the inside of the cavity, through the aperture, to the surrounding plasma. The heating for the emitting surface inside the cavity comes from ion bombardment. If the voltage to extract electrons is increased, this increased voltage appears as an increased voltage between the emitting surface and the plasma inside the cavity, resulting in turn in an increase in bombardment energy for the ions striking the emitting surface, an increase in temperature of that surface, and therefore an increase in emission. Experimentally, a wide range of electron emission is possible for only small changes in coupling voltage.

Compared to a hot filament, a hollow cathode couples easily to the surroundings, without the space-charge limitations of the former. This ease of coupling results from the "plasma bridge" that extends through the aperture to the surrounding device and/or discharge plasma and provides the ions to charge-neutralize the electrons that are emitted. The plasma bridge permits the hollow cathode, when used as a neutralizer, to be located outside of the energetic ion beam, thereby avoiding erosion by the energetic ions in that beam.

A hollow cathode usually also has a longer lifetime than a hot filament, although reactive gases can also reduce this lifetime. Depending on details of construction and operation of a hollow cathode, the flow of ionizable gas through the aperture may tend to exclude an external reactive gas from the sensitive emitting surface inside the cavity.

There is also a tendency for the bulk of the emission to come from the emitting surface closest to the aperture, resulting in preferential erosion or consumption of the emitting material in that location. This tendency results from the plasma density, ionic bombardment, and heating being greatest near the aperture, which in turn results in the greater emission at that location.

The wide range of electron emission that is possible from a hollow cathode with little variation in coupling voltage can be an advantage in some applications, but a disadvantage in others where the ability to electrically control or limit the emission is important. Complicated electronic circuitry external to the hollow cathode is required to control or limit the emission.

Yet another electron emitting cathode is what is often called the plasma bridge type. It should be noted that "plasma bridge" is used both in the name of an electron emitting cathode and in the description of operation of some electron emitting cathodes. The possible confusion is unfortunate, but is inherent in the language used in the scientific literature. The emission in the plasma bridge cathode is also thermionic, but depends on an external source of electrical power for heating. The thermionic emission can be directly from a hot filament within the cavity, as described in an article by Reader, et al., in the *Journal of Vacuum Science and Technology*, Vol. 15 (1978), beginning on page 1093. Or the thermionic emission can be from an emitter within the cavity that is heated indirectly by an electrically energized heating element also within the cavity, as described in U.S. Pat. No. 4,297,615—Goebel, et al.

The plasma bridge type of electron emitting cathode also has a plasma extending from inside the cavity, through the aperture, to the surrounding plasma, similar to the plasma bridge in the hollow cathode. The plasma bridge type also has a close electrical coupling with the surrounding device and/or plasma similar to the hollow cathode.

The plasma bridge cathode thus shares some advantages and disadvantages with both the hot filament and hollow cathode. It shares the close electrical coupling and moderate resistance to reactive gases with the hollow cathode. It also shares both the advantage of control of emission and the shortcomings of a hot filament with the hot filament cathode.

The foregoing types of electron emitting cathodes are the most common types used in low pressure plasma devices. The adverse environment of ion bombardment in these devices prevents the use of electron emitting cathodes with delicate emission enhancing surfaces, such as oxides, that are directly exposed to, and unprotected from, surrounding plasmas. Thoriated tungsten has similar shortcomings. The thoria is distributed through the tungsten, but conditioning thoriated tungsten for use results in a surface condition that is rapidly destroyed by ion bombardment.

SUMMARY OF INVENTION

In light of the foregoing, it is an overall general object of the invention to provide an improved hollow cathode that is simple, compact, and reliable.

Another object of the present invention is an improved hollow cathode that provides direct electrical control of maximum electron emission without using a hot filament as either an emitter or heater.

A further object of the present invention is to provide an improved hollow cathode that better utilizes the available emitting surface, rather than permitting most of the emission to come from only a small portion of that surface.

Yet another object of the present invention is to achieve the above objectives while retaining the tendency of a conventional hollow cathode to exclude an external reactive gas from the electron emitting surface inside the cavity.

A still further object of the present invention is to achieve the above objectives while retaining the close electrical coupling of the cathode with the surrounding plasma that is achieved with a conventional hollow cathode.

In accordance with one specific embodiment of the present invention, the closed drift hollow cathode comprises an axisymmetric discharge region into which an ionizable gas is introduced, an annular electron emitting cathode insert disposed laterally about that discharge region, a surrounding enclosure, an aperture in said enclosure disposed near the axis of symmetry and at one end of said region, and a magnetic field within said region which is both axisymmetric and generally disposed transverse to a path from said cathode insert to said aperture. The cathode insert is biased negatively relative to the surrounding enclosure, establishing both an electrical discharge and a discharge plasma in the discharge region. The electrons emitted from the cathode insert drift in closed paths around the axis, collide with molecules of ionizable gas, and sustain the discharge plasma by generating additional electron-ion pairs. Ions from the plasma bombard the cathode insert, thereby maintaining an emissive temperature. Electrons from the plasma diffuse to and escape through the aperture to provide the electron emission. Ions also escape through the aperture to charge neutralize the electrons. The closed drift nature of the discharge circumferentially distributes the heating of the cathode insert and the utilization of the electron emitting capabilities thereof. The discharge current between the cathode insert and the enclosure establishes a maximum value on the electron emission, approximately equal to the discharge current, thereby avoiding excessive and damaging increases in electron emission during electrical breakdowns of related equipment.

DESCRIPTION OF FIGURES

Features of the present invention which are believed to be patentable are set forth with particularity in the appended claims. The organization and manner of operation of the invention, together with further objectives and advantages thereof, may be understood by reference to the following descriptions of specific embodiments thereof taken in connection with the accompanying drawings, in the several figures of which like reference numerals identify like elements and in which:

It may be noted that the aforesaid schematic cross-sectional views represent the surfaces in the plane of the section while avoiding the clutter which would result were there also a showing of the background edges and surfaces of the overall generally-cylindrical-assemblies.

DESCRIPTION OF PRIOR ART

Figure 1:
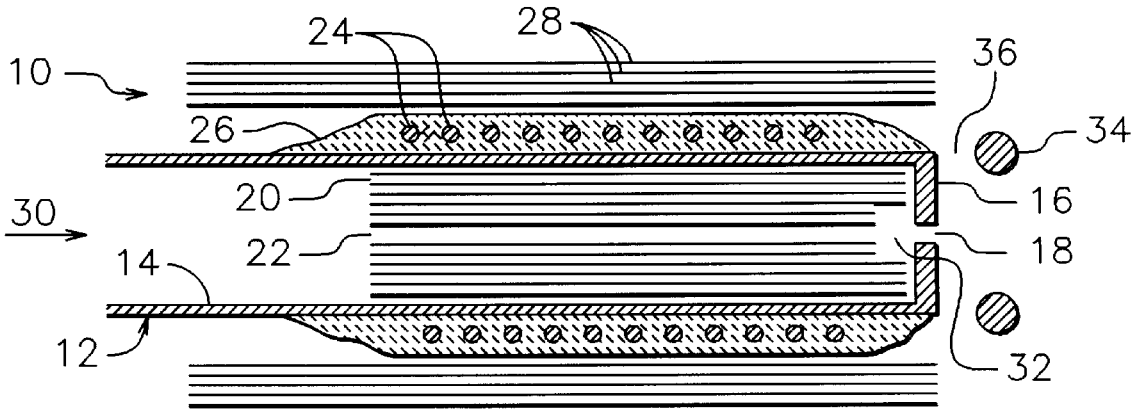
(PRIOR ART) Fig. 1
FIG. 1 is a schematic cross-sectional view of a prior-art hollow cathode.

Referring to FIG. 1, there is shown an approximately axisymmetric prior art hollow cathode 10. There is an enclosure 12 which comprises a tantalum tube 14 that is welded to a tungsten end plate 16, through which there is an aperture 18. Inside the enclosure and near the tungsten end plate is electron emissive insert 20. The emissive insert may, as indicated in FIG. 1, be constructed of rolled tantalum foil, with the fabrication of the insert completed by impregnating it between the layers with barium oxide. Alternatively, it may be of porous nickel or porous tungsten, with the porous structure impregnated with an emission enhancing oxide. It should be noted that the emissive enhancing material can originally be a carbonate, which is heated in vacuum to condition it and reduce it to an oxide.

There is a passage 22 through the emissive insert. Surrounding enclosure 12 is an electrical heater 24 to bring that enclosure to operating temperature before starting operation. In this particular heater configuration, the heater 24 is imbedded in a matrix of alumina 26 which holds the heater in place, provides thermal contact with the enclosure 12, and at the same time provides electrical insulation between heater wires and between the heater and the tube 14. It should be noted here that the heater 24 may alternatively be of coaxial construction where the resistance wire has a surrounding insulation and an outer metallic tube that is insulated from the heater. This coaxial heater may then be wrapped directly around tube 14, with the required electrical insulation provided internally in the coaxial construction. The outer metallic tube of the coaxial heater may be welded to the tube 14 to provide thermal contact, or the heating may be by radiation between the heater and the tube.

Regardless of the heater construction, it is customary to provide thermal insulation 28 around the heater 24 to minimize the electrical power required for enclosure 12 to reach operating temperature, as well as the temperature difference between the heater and the enclosure. This thermal insulation is usually provided by multiple layers of tantalum foil.

An ionizable gas 30 is introduced into enclosure 12, flows first through passage 22 in emissive insert 20, then flows through discharge region 32, and finally escapes from the hollow cathode 10 through aperture 18. Outside of the enclosure is the keeper 34 which is separated from the enclosure by a spacing 36.

Figure 2:
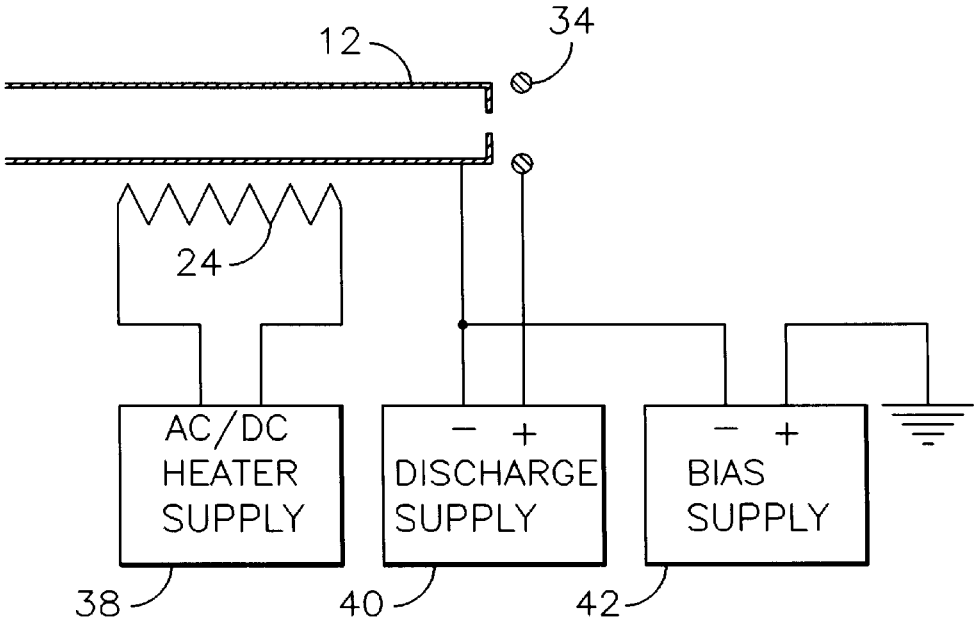
(PRIOR ART) Fig. 2
FIG. 2 is an electrical schematic for use with the prior art hollow cathode shown in FIG. 1.

Operation of the prior art hollow cathode of FIG. 1 can be understood by the additional reference to FIG. 2. Electrical power is provided to the heater 24 by heater supply 38, heating enclosure 12 to operating temperature. Heater supply 38 can be either direct or alternating current, as long as the voltage and current can satisfy the resistance characteristics of heater 24. With an adequate flow of ionizable gas (30 in FIG. 1), operation is initiated by a positive voltage on keeper 34 relative to enclosure 12, which is provided by discharge supply 40. The flow of ionizable gas is usually reduced after the discharge is initiated.

It is typical for several hundred volts to be required for the initiation of a discharge. After it is initiated, the discharge voltage drops to 20–40 V. The characteristics of the discharge supply are selected to accommodate this range of voltage. After a discharge is established between the keeper 34 and the enclosure 12, the emission can be controlled with the voltage and/or current of the bias supply 42. If the electron emission current (which returns to the cathode through the bias supply) is sufficiently large, emission from the hollow cathode will continue with both the heater supply 38 and the discharge supply 40 turned off.

Most of the ionizable gas escapes from aperture 18 as neutral molecules or atoms. There are also ions that are carried out with the neutrals. These ions serve to neutralize the space charge of the electrons and together with them form the conductive plasma bridge described in the Background Art section.

Returning to the configuration shown in FIG. 1, the discharge region 32 is shown as having a larger diameter than the passage 22. Whether this increase in diameter exists or not depends on things such as the diameter of passage 22, the materials used for the emissive insert 20, and the level of electron emission required from the insert. The reason for such a design feature, when it is used, is the tendency for both the heating of the insert by the discharge and the resultant thermionic emission to concentrate at the end of the insert closest to the aperture 18. This localized heating can result in poor utilization of the emissive material in the insert or, in extreme cases, localized thermal damage. The purpose of the increased diameter is primarily to reduce the density of the discharge at the insert and thereby avoid the possibility of damage. There is a practical limit to the increase in diameter that can be used, however, because of the tendency of low density discharges to concentrate on one localized cathode area, even if a larger area is equally accessible.

As another possible variation of the configuration shown in FIG. 1, the keeper 34 may be part of a structure that encloses the end of the hollow cathode 10, increases the pressure between the keeper and end plate 16, and thereby promotes initiation of the discharge.

The devices that use hollow cathodes similar to that described in connection with FIGS. 1 and 2 were described earlier. These devices can have electrical breakdowns. The voltages of various electrodes in these devices can fluctuate rapidly during electrical breakdowns, resulting in corresponding variations in electron emission that can cause damage to the devices. If the electron emission from the hollow cathode is to be limited during a breakdown, this limit must be provided by a fast acting current limit in the bias supply 42. It is typical of these breakdowns that the currents rise extremely rapidly, so that fast acting electronic controls are required to limit these currents. It would be advantageous if the limitation on emission were inherent in the hollow cathode, rather than an external power supply. It would be additionally advantageous if this emission limit could be varied in some simple electrical manner.

DESCRIPTION OF THE PREFERRED EMBODIMENTS

Figure 3:
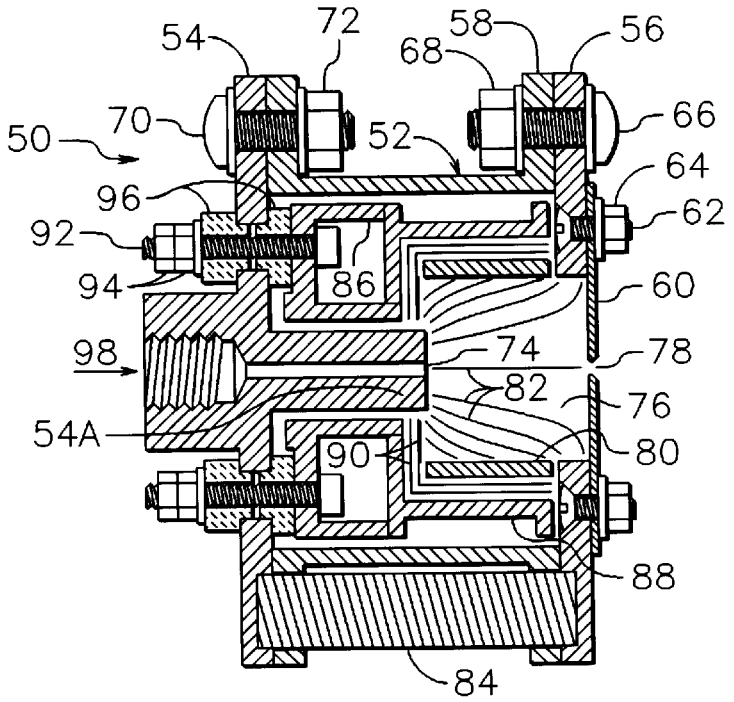
FIG. 3 is a schematic cross-sectional view of a closed drift hollow cathode constructed in accordance with one specific embodiment of the present invention.

FIG. 3 represents an approximately axisymmetric closed drift hollow cathode 50 that is one embodiment of the present invention. There is an enclosure 52 that comprises a first pole piece 54 that is circular in shape with a cylindrical extension 54A and has a relative magnetic permeability substantially greater than unity, a second pole piece 56 that is annular in shape and has a relative magnetic permeability substantially greater than unity, a nonmagnetic outer shell 58, and a nonmagnetic aperture plate 60. The aperture plate 60 could also have a relative magnetic permeability substantially above unity, but the refractory materials selected for this part are usually nonmagnetic. Screws 62 and matching nuts 64 are used to attach aperture plate 60 to second pole piece 56 at several locations around the circumference. In a similar manner screws 66 and matching nuts 68 are used to attach the second pole piece 56 to outer shell 58 at several locations around the circumference, and screws 70 and matching nuts 72 are used to attach the first pole piece 54 to outer shell 58 at several locations around the circumference. An ionizable gas 98 is introduced through passage 74 in cylindrical extension 54A of first pole piece 54, flows through discharge volume 76, and leaves through aperture 78, which is approximately centered relative to second pole piece 56.

The electrical discharge is between the enclosure 52 and the annular electron emitting cathode insert 80. There is a magnetic field 82 that is generally transverse to a path between the cathode insert 80 and aperture 78, that causes the electrons in the discharge region to precess or drift circumferentially in closed paths about the axis of symmetry. This motion is the basis of the name for this electron source. The magnetic field is generated by permanent magnets 84, which extend from the first pole piece 54 to the second pole piece 56 at several locations around the circumference. Structural members 86 and 88 support the thermal insulation 90 which in turn supports cathode insert 80. The structural members 86 and 88 are held in place by screws 92 and nuts 94, as well as positioned relative to first pole piece 54 by ceramic insulators 96. Electrical contact to cathode insert 80 is through screws 92, structural members 86 and 88, and thermal insulation 90. A separate electrical connection (not shown) may be useful between cathode insert 80 and structural member 88 to assume good electrical contact to the cathode insert.

Figure 4:
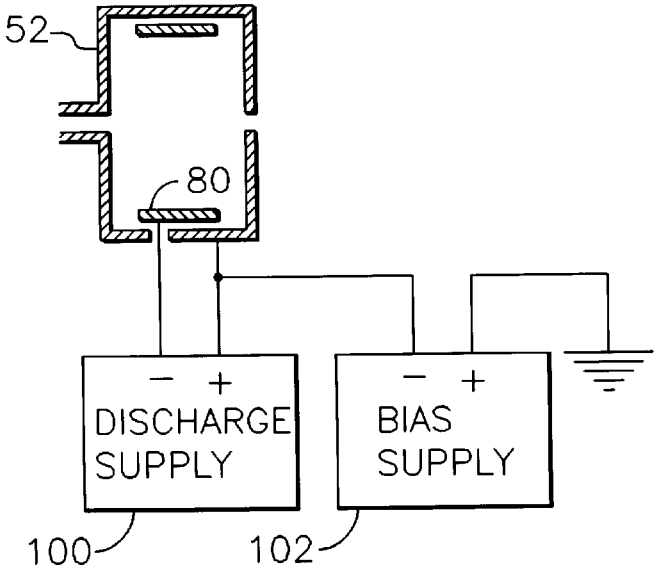
FIG. 4 is an electrical schematic that can be used for the specific embodiment of the present invention shown in FIG. 3.

Operation of the closed drift hollow cathode of FIG. 3 can be understood by the additional reference to the electrical schematic of FIG. 4. Prior to operation, an adequate flow of ionizable gas (98 in FIG. 3) must be established. A discharge is then initiated with a voltage of several hundred volts between the cathode insert 80 and the enclosure 52, with this voltage coming from discharge supply 100. The flow of ionizable gas is usually reduced after the discharge is initiated, and the discharge voltage drops to 20–40 V. If a voltage is applied between the hollow cathode 50 and the environment by bias supply 102, the initiation of a discharge is normally accompanied by the initiation of electron emission. The voltage from the bias supply can be varied to control the electron emission at values below the maximum value determined by the current in the discharge supply 100. The voltage of the bias supply 102 is 20–50 volts during normal operation.

Most of the ionizable gas escapes from aperture 78 as neutral molecules or atoms. Some of the molecules or atoms of the ionizable gas leave aperture 78 in an ionized state, typically with one electron missing. These ions serve to neutralize the space charge of the electrons and together with them form the conductive plasma bridge described in the Background Art section. The current of the emitted ions is small compared to that of the emitted electrons, so that the current in the bias supply 102 is a close approximation of the electron emission.

Figure 5:
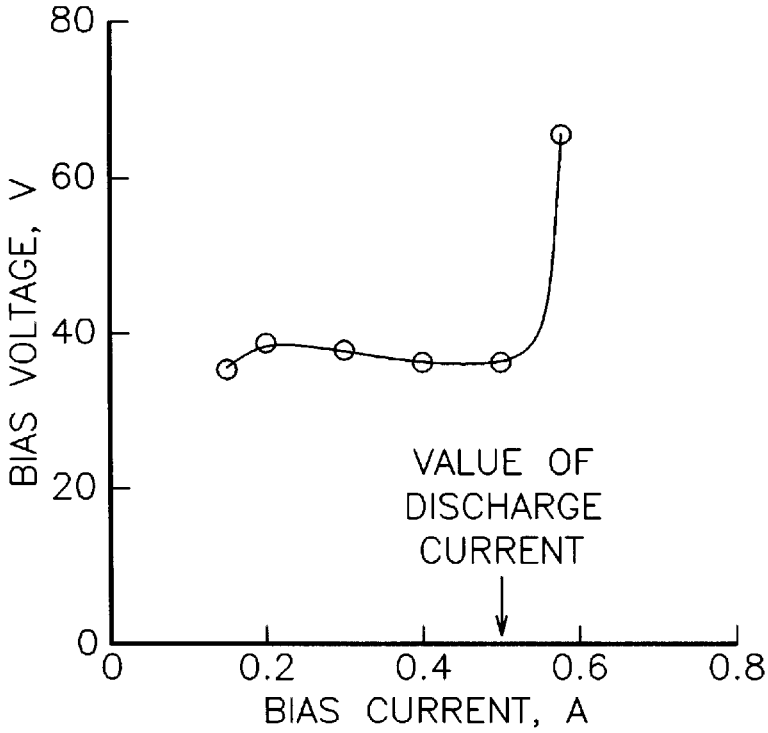
FIG. 5 is the voltage-current characteristic of the bias supply for the closed drift hollow cathode shown in FIG. 3 and operated with the electrical schematic of FIG. 4.

A voltage-current characteristic of the bias supply 102 is shown in FIG. 5 for the hollow cathode shown in FIG. 3 and operated with the electrical schematic of FIG. 4. The cathode insert 80 was made of tantalum, which, compared to other likely material choices, has a higher erosion rate, but also has an advantage that it is insensitive to exposure to air. The current of discharge supply 102 was, as indicated in FIG. 5, 0.5 Ampere. The bias voltage varied only several volts over most of the range of bias current, but rose rapidly as the bias current increased above 0.5 Ampere, showing a limitation on the bias current that is inherent of a hollow cathode 50 when used with the electrical schematic of FIG. 4.

As described above, the electron emission from hollow cathode 50 shown in FIG. 3 corresponds closely to the current through bias supply 102 in FIG. 4. The following discussion will use the practical assumption that the two currents are equal. The limitation on maximum emission shown in FIG. 5 can be shown to depend on the use of the electrical schematic shown in FIG. 4. The approximate limit on emission from cathode insert in FIG. 3 is set by the current from discharge supply 100. As the emission increases from a low value, the electron current collected by enclosure 52 decreases. When the emission equals the discharge current, the enclosure picks up no current. In practice, the ions have a low but still finite mobility compared to the electrons, so an emission greater than the discharge current can be reached with some ion collection by enclosure 52. Attempting to increase the emission beyond this approximate limit will, however, result in a sharp increase in bias voltage with little or no increase in emission, as shown in FIG. 5 near a bias current of about 0.6 A. It should be noted that this limit could be established in a passive manner. For example, the current limit of discharge supply 52 could result from a high voltage supply in series with a correspondingly high resistance. More specifically, the limitation on emission is determined by a steady state operating parameter (discharge current) and does not require a separate overload protection circuit to detect and respond to an electrical breakdown with a fast rise time.

ALTERNATE EMBODIMENTS

Figure 6:
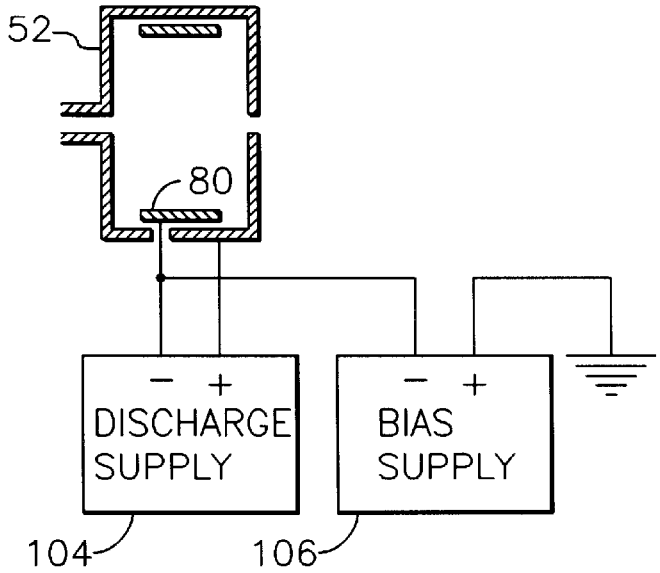
FIG. 6 is an alternative electrical schematic of the specific embodiment of the present invention shown in FIG. 3.

An alternative electrical schematic is shown in FIG. 6 that could be used with the hollow cathode embodiment of FIG. 3. The difference from the electrical schematic of FIG. 4 is that the negative terminal of bias supply 104 is connected to the negative terminal of discharge supply 106 in FIG. 6, whereas in FIG. 4 the negative terminal of bias supply 102 is connected to the positive terminal of discharge supply 100. For the same steady-state operating condition for the hollow cathode 50, the voltages of the two discharge supplies would be the same and the currents of the two bias supplies would be the same, but the current of discharge supply 104 would equal the current of discharge supply 100 minus the current of bias supply 102 and the voltage of bias supply 106 would equal the sum of the voltages of discharge supply 100 and bias supply 102.

While other features of the hollow cathode embodiment shown in FIG. 3 would be unaffected, there would be no limitation on emission when the alternative electrical schematic of FIG. 6 is used. This can be shown by considering the operation as the emission is varied. Assuming the electrical schematic of FIG. 6, an increase in electron emission from hollow cathode 50 results in an increase of electron emission from cathode insert 80 and no change in electron collection by enclosure 52. There is no limit reached where the current to the enclosure approaches zero and no sharp rise in bias voltage when further increases in emission from hollow cathode 50 are attempted.

It is assumed in FIGS. 4 and 6 that the bias supplies are connected to a reference potential (shown as ground) at the positive terminal. Depending on the device in which the hollow cathode is used, it may be desirable to connect the bias supply to a more negative potential, so that the enclosure 52 is more positive than the reference potential. The current would then pass through the supply in the reverse direction to its voltage. This problem could be accommodated by using a ballast resistor on the power supply that carried a current in the normal direction that was larger than the reverse current. Alternatively, although it would have poor current and voltage regulation, a simple variable resistor to the reference potential could serve as a bias supply. These alternate embodiments are described to show that the polarities of the bias supplies shown in FIGS. 4 and 6, although likely, are not the only possibilities. Further, as long as the bias supply is connected to the enclosure 52 instead of the cathode insert 80, there would be a limitation on emission regardless of the polarity used for the bias supply.

Figure 7:
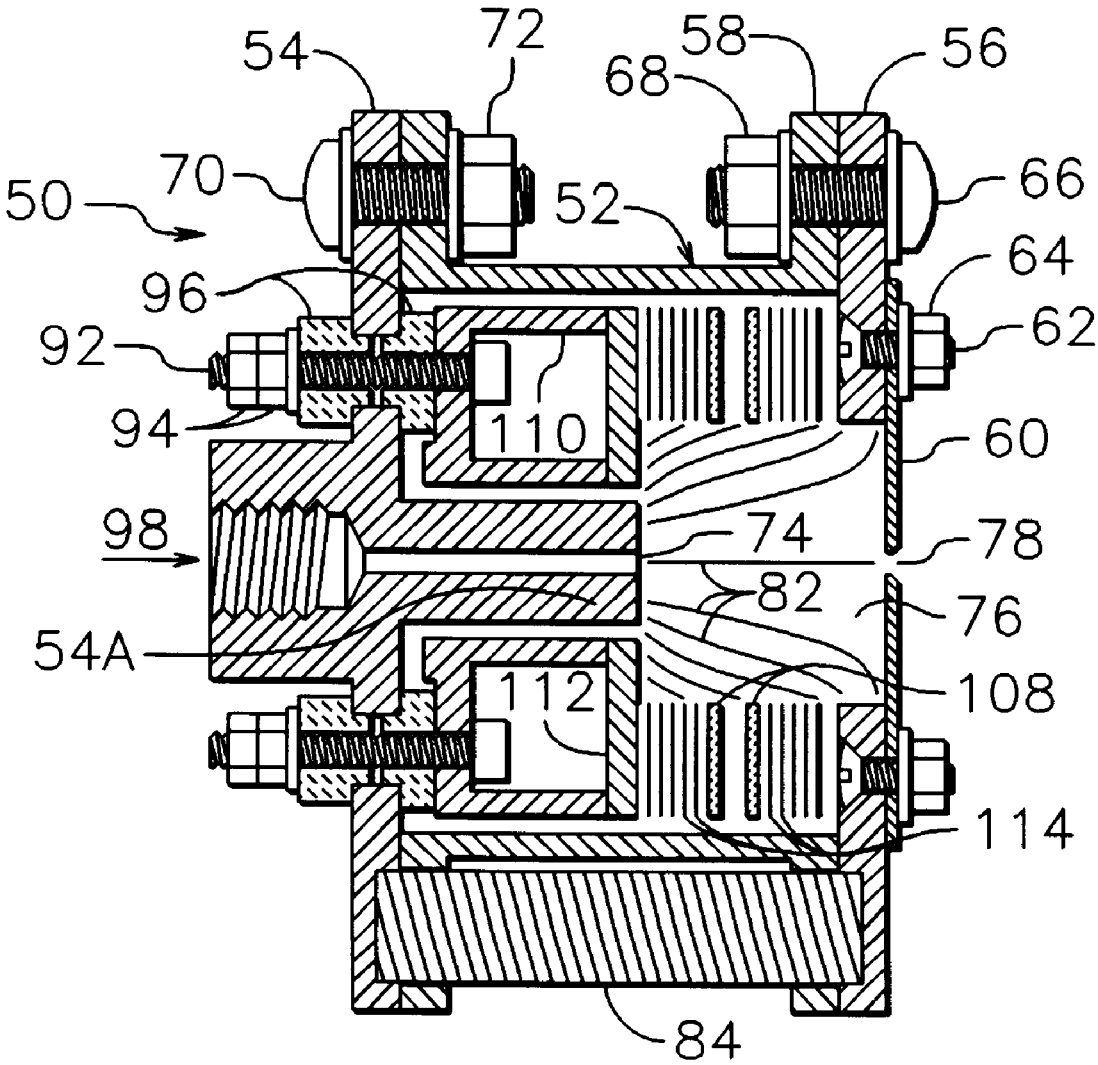
FIG. 7 is a schematic cross-sectional view of a closed drift hollow cathode constructed in accordance with another specific embodiment of the present invention.

As another example of an alternate embodiment, a closed drift hollow cathode with a different configuration of cathode insert is shown in FIG. 7. The electrical discharge is between the enclosure 52 and the electron emitting cathode insert 108. There is a magnetic field 82 that is generally transverse to a path between the annular cathode insert 108 and aperture 78, that again causes the electrons in the discharge region to precess or drift circumferentially in closed paths about the axis of symmetry. Structural members 110 and 112 support the thermal insulation 114 which in turn supports cathode insert 108. The structural members 110 and 112 are held in place by screws 92 and nuts 94, as well as positioned relative to first pole piece 54 by ceramic insulators 96.

The cathode insert 108 in FIG. 7 comprises two annular sheets of lanthanum hexaboride that face each other, with the thermal insulation behind each sheet of lanthanum hexaboride provided by ten annular sheets of molybdenum. The locations of the two parts of the cathode insert and the spacing between them was provided with additional screws, nuts, and washers (not shown). Lanthanum hexaboride is a ceramic material that has enhanced electron emission properties approaching those of an oxide impregnated insert, but with less sensitivity to atmospheric exposure.

As another example of an alternate embodiment, different shapes could be used for pole pieces. The omission of the cylindrical extension 54A on the first pole piece 54 increased the discharge power required for a given level of electron emission, but it did not qualitatively change the operation. Pole piece shapes that are different from those shown in FIGS. 3 and 7 are therefore possible.

SPECIFIC EXAMPLE

As a specific example of operation, a configuration similar to that shown in FIG. 7 was used with an electrical circuit similar to that shown in FIG. 4. The aperture plate 60 was made of tantalum and pole pieces 54 and 56 were made of low carbon steel. Outer shell 58 and structural members 110 and 112 were made of nonmagnetic stainless steel. The drawing in FIG. 7 is approximately to scale. There were eight alnico 5 magnets distributed uniformly around the circumference and the aperture 78 had a diameter of 1.5 mm. With an argon gas flow of 7 sccm (standard cubic centimeters per minute) and a 2 ampere, 38 volt discharge, the emission was 1.0 ampere at a bias voltage of 50 volts. A metallic plate was used to collect the electron emission. The bias voltage may appear high, but it is normal for the bias voltage to be higher when the electron conduction is to a metallic electrode instead of a plasma. Erosion measurements of the cathode insert indicated an expected lifetime of hundreds of hours.

While particular embodiments of the present invention have been shown and described, and various alternatives have been suggested, it will be obvious to those of ordinary skill in the art that changes and modifications may be made without departing from the invention in its broadest aspects. Therefore, the aim in the appended claims is to cover all such changes and modifications as fall within the true spirit and scope of that which is patentable.

We claim:

1. A closed drift hollow cathode electron source comprising:

an axisymmetric discharge region, having an axis of symmetry, into which an ionizable gas is introduced;

an annular electron emitting cathode insert disposed laterally about said region;

a surrounding enclosure;

an aperture in said enclosure disposed near said axis of symmetry and at one axial end of said region;

a magnetic field within said region which is both axisymmetric and generally disposed transverse to a path from said cathode insert to said aperture; and a power supply means for establishing an electrical discharge between said cathode insert and said enclosure.

2. A closed drift hollow cathode electron source as defined in claim 1 in which:

the wall of the enclosure opposite the aperture comprises a first pole piece that has a relative permeability substantially greater than unity;

the wall of the enclosure surrounding the aperture comprises a second pole piece that has a relative permeability substantially greater than unity; and a magnetic source means, external of said discharge region, to magnetically energize said first and second pole pieces and thereby generate said magnetic field.

3. A closed drift hollow cathode electron source as defined in claim 2 in which:

said first pole piece is circular with a cylindrical extension; and said second pole piece is annular.

4. A closed drift hollow cathode electron source as defined in claims 1, 2, or 3 in which said enclosure is biased to initiate electron emission through said aperture and regulate said emission during normal operation.

5. A closed drift hollow cathode electron source as defined in claim 4 in which said bias of said enclosure is provided by the negative terminal of a bias supply, with the positive terminal of said bias supply connected to a reference potential in the apparatus in which said hollow cathode is used.

6. A closed drift hollow cathode electron source as defined in claim 4 in which said bias of said enclosure is provided by the positive terminal of a bias supply, with the negative terminal of said bias supply connected to a reference potential in the apparatus in which said hollow cathode is used.

7. A method for emitting electrons from a generally axisymmetric enclosure means through an aperture at one end in said enclosure means, the method comprising the steps of:

(a) providing a generally annular cathode insert means laterally disposed in said enclosure means relative to said aperture;

(b) providing a generally axisymmetric magnetic field means within said enclosure means wherein the magnetic field direction is generally disposed transverse to a path from said cathode insert to said aperture;

(c) introducing a gas, ionizable to produce a plasma, into said enclosure means; and (d) biasing said cathode insert means negative relative to said enclosure means to produce a discharge within said enclosure means.

8. A method in accordance with claim 7 comprising the further step of:

(a) biasing said enclosure means to initiate and regulate the electron emission through said aperture.

* * * * *